US006317145B1

(12) United States Patent
Myung

(10) Patent No.: US 6,317,145 B1
(45) Date of Patent: Nov. 13, 2001

(54) METHOD AND DEVICE FOR CONTROLLING A CARRIAGE IN AN INK JET APPARATUS

(75) Inventor: Ho-Suck Myung, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/198,406

(22) Filed: Nov. 24, 1998

(30) Foreign Application Priority Data

Nov. 24, 1997 (KR) ..... 97-62290

(51) Int. Cl.[7] ..... B41J 23/00; B41J 29/393
(52) U.S. Cl. ..... 346/16; 347/37; 347/19
(58) Field of Search ..... 347/16, 19, 37, 347/39

*Primary Examiner*—John Barlow
*Assistant Examiner*—Alfred Dodding

(74) *Attorney, Agent, or Firm*—Robert E. Bushnell, Esq.

(57) ABSTRACT

A method and a device for controlling the motion of a carriage in an ink jet apparatus. First, the printer receives a signal representing a command to replace the cartridge mounted on the carriage. Then, a paper detection device determines whether paper is present in the printing area of the printer. If paper is detected in the printing area, then the carriage is moved outside of the printing area. When no paper is detected by the paper detection sensor, the carriage is moved to the center of the printing area. Then, a user replaces the old ink cartridge with a new ink cartridge and sends a command to the printer indicating that the replacement process is completed. Then the carriage is returned to the position it occupied prior to the printer receiving the replace cartridge command. This method and device reduces the amount of time consumed waiting for a carriage to be moved from the printing area, reduces the probability of polluting a sheet of paper that is within the printing area during the replacement of an ink cartridge, allows more space around the cartridge to facilitate the removal of the cartridge, and moves the carriage to a position depending on whether paper is detected in the printing area.

20 Claims, 5 Drawing Sheets

METHOD AND DEVICE FOR CONTROLLING A CARRIAGE IN AN INK JET APPARATUS

CLAIM OF PRIORITY

This application makes reference to, incorporates the same herein, and claims all benefits accruing under 35 U.S. C. §119 from my application entitled *A Printer Having a Carriage Control Apparatus and Method Thereof* filed with the Korean Industrial Property Office on Nov. 24, 1997 and there duly assigned Ser. No. 97-62290 by that Office.

BACKGROUND OF THE INVENTION

1. Field of the Invention

This invention relates to ink jet apparatus that uses an ink cartridge and, more specifically, to a device and a method for controlling a printer carriage that needs to be replaced.

2. Background Art

With the increasing amount of data that must be archived stored and presented constantly increasing, more efficient ink jet devices have been developed to meet increasing performance demands. Different methods of printing have been developed, such is the dot-matrix method, the electronic picture-developing method, and the ink-jet method. Among these methods, the ink jet printer has developed a system of forming images on cut sheets of paper that is efficient and economical. There are two types of ink-jet printers, the continuous jet type and the drop on demand type of ink jet printer. The continuous ink-jet printers project a continuous spray of ink drops from a small nozzle toward a recording medium. In contrast, the drop on demand ink-jet printers release droplets in response to signals from a controller. The controller causes changes in the pressure within the ink storage chamber of the printer cartridge resulting in a succession of droplets being ejected. Many advancements have been made in ink-jet technology due to continuing efforts to increase printer speed and to improve the resolution of printed images.

It has been noticed that contemporary ink-jet printers tend to be inefficient when the ink cartridge must be replaced. When a printer receives the command to replace a cartridge the printer transports the cartridge outside of the printing area. This is important as ink can often leak from the cartridge due to shocks that are generated while removing and inserting cartridges into the carriage. Thus, by removing the carriage from the printing area of the printer, the sheet of paper that is being printed upon will not be contaminated by ink.

The moving of the carriage outside of the printing area, however, results in both a loss of time that can be significant when a highly used printer needs frequent cartridge replacement and results in reducing the amount of free space surrounding the cartridge during the removal process, thus making replacement more difficult. As such, it may be possible to improve on the contemporary art of ink jet devices by providing a method and a device for controlling a carriage that reduces the amount of time consumed waiting for a carriage to be moved from the printing area, that reduces the probability of polluting a sheet of paper that is within the printing area during the replacement of an ink cartridge, that allows more space around the cartridge to facilitate the removal of the cartridge, and that moves the carriage to a position depending on whether paper is detected in the printing area.

SUMMARY OF THE INVENTION

Accordingly, it is an object of the present invention to provide an improved method and an improved device for controlling the carriage in an ink jet apparatus.

It is another object to provide a method and a device for controlling the carriage in an ink jet apparatus that reduces the time consumed waiting for a carriage to be removed from the printing area.

It is still another object to provide a method and a device for controlling the carriage in an ink jet apparatus that reduces the probability of polluting a sheet of paper that is within the printing area during the replacement of an ink cartridge.

It is yet another object to provide a method and a device for controlling the carriage in an ink jet apparatus that moves the carriage to a position depending on whether paper is detected in the printing area.

To achieve these and other objects, a method and a device are provided for controlling the position and motion of a carriage. The method starts with the printer receiving a signal representing a command to replace the cartridge mounted on the carriage. A controller, or microprocessor, then detects whether paper is present in the printing area of the electrophotographic device. The printing area is the area beneath the nozzles in the printer over which the cartridge can apply ink during one pass of the carriage over the paper. If paper is detected in the printing area, then the carriage is moved outside of the printing area. When no paper is detected by the paper detection sensor, the carriage is moved to the center of the printing area. At this time, a user replaces the old ink cartridge with a new ink cartridge and sends a signal or command to the printer indicating that the replacement process is completed. When the controller receives a command indicating the replacement process is completed, the carriage is returned to the position it occupied prior to the printer receiving the replace cartridge command.

These objects can be achieved by providing a printer having a controller, or microprocessor, that can receive a cartridge replacement command from a user via a control panel or other interface device, such as computer system. When the controller receives the replacement command, it checks the output of a paper detection sensor to determine whether paper is present in the printing area of the printer. If paper is present in the printing area, then the controller activates a carriage return driver, that causes a carriage return motor to move the carriage from the printing area. If paper is not detected in the printing area, then the controller activates the carriage return driver causing the carriage to be moved to the center of the printing area. Then, a user replaces the cartridge and sends a command to the printer signifying the completion of the cartridge exchange. Upon receiving a command indicating the completion of the cartridge exchange, the controller causes the carriage return motor to return the carriage to the position the carriage originally occupied prior to the receipt of the exchange command by the printer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF THE DRAWINGS

Figure 1:
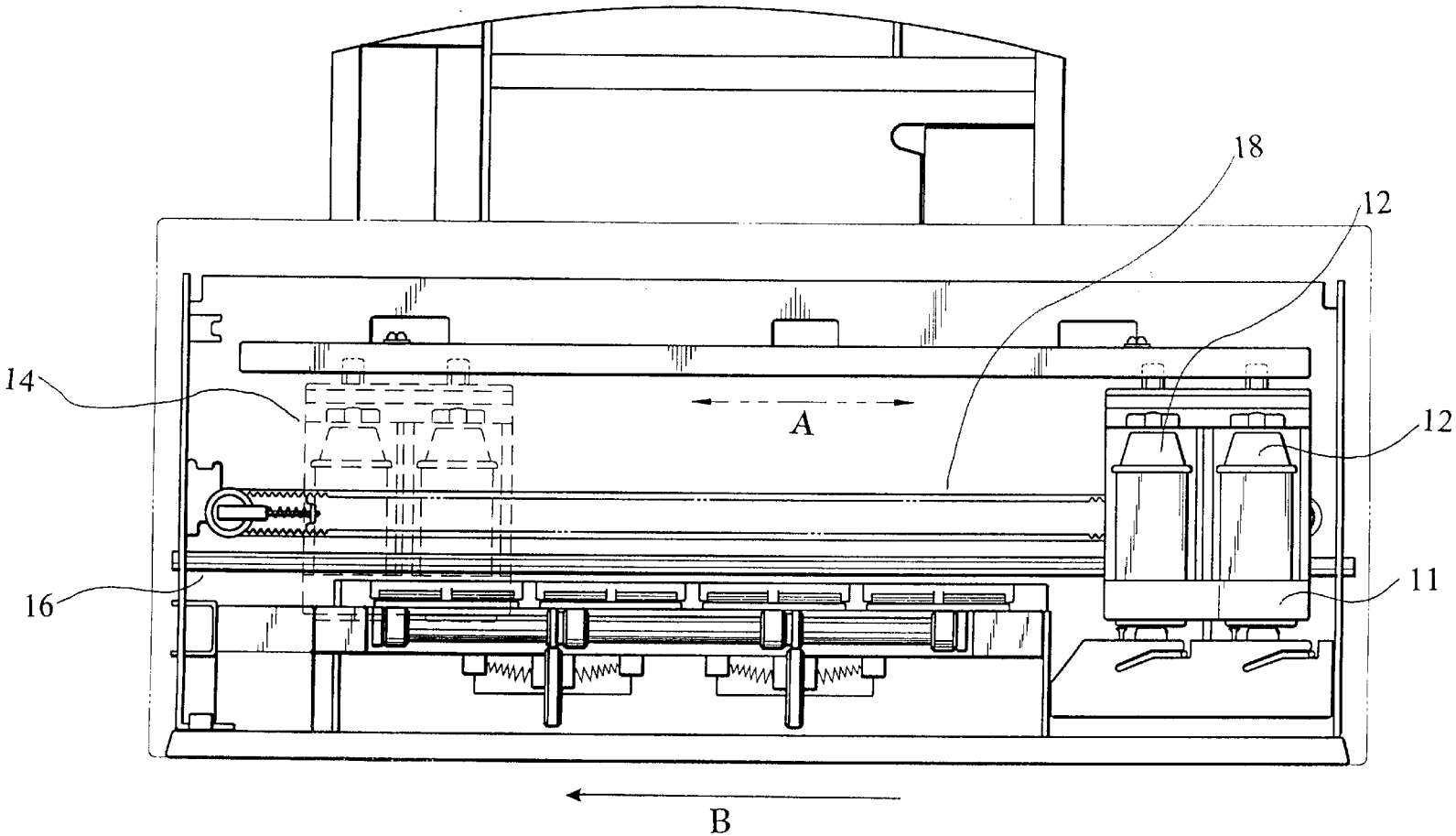
FIG. 1 is partially exposed front view of an ink jet apparatus.
Figure 2:
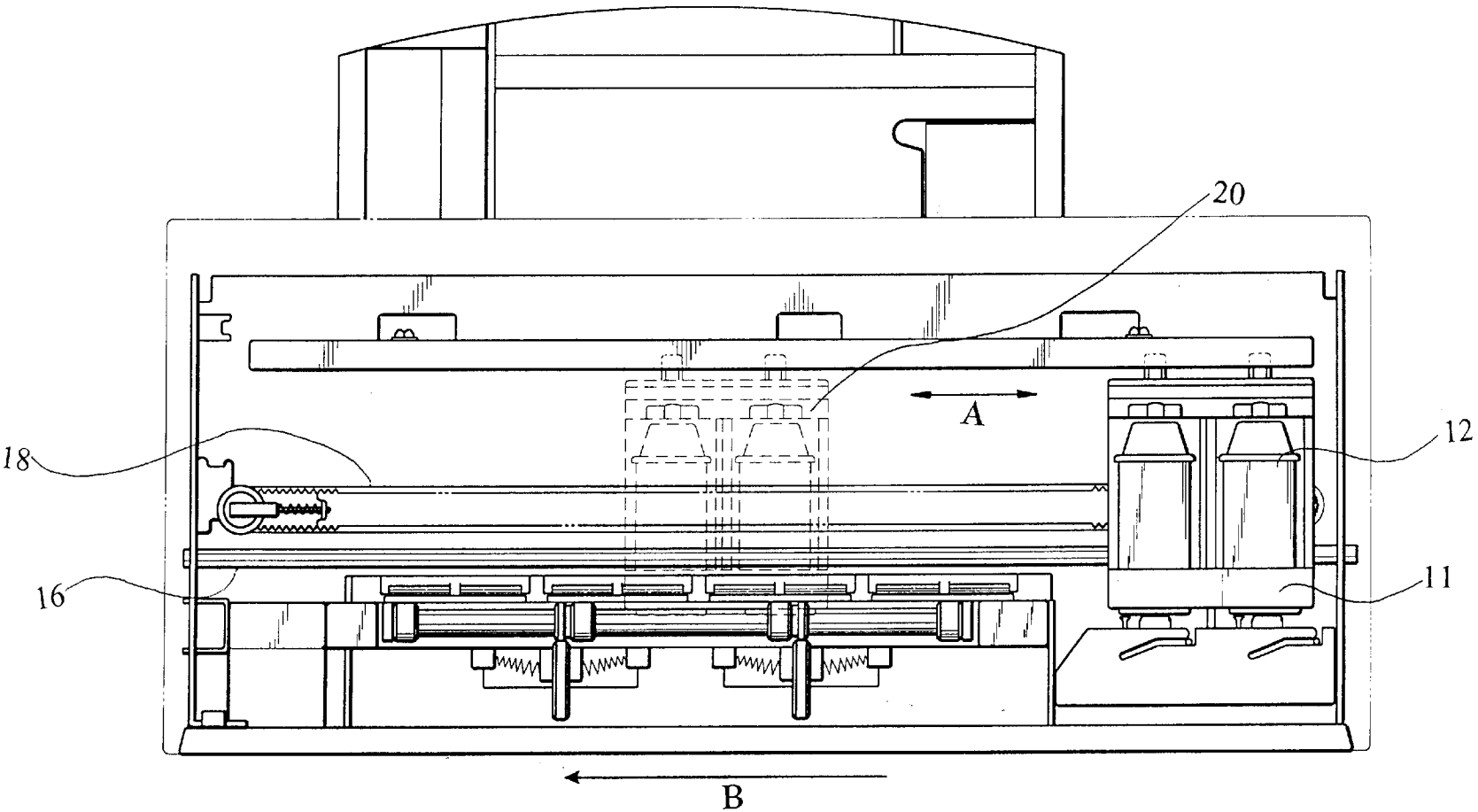
FIG. 2 is partially exposed front view of an ink jet apparatus.

Turning now to the drawings, FIGS. 1 and 2 illustrate a printer that uses a rectilinear reciprocating moving ink cartridge 12. Cartridge 12 is mounted inside carriage 11 that is slidably attached to shaft 16 so that the carriage can be moved in the directions labeled "A". The carriage is controlled by a motor (not shown) that moves belt 18 to slide the carriage along the shaft. In FIG. 1, the cartridge and carriage are shown outside the printed area by dashed lines 14. The area outside of the printing area is also referred to as the first stop position. When a user needs to change ink cartridge 12, a command is input into the printer by pressing a button on a control panel of the printer of by using a computer driver via an operating system to send a command to the printer. Then the controller (not shown) causes the cartridge to move in the direction denoted "B" until the carriage has moved to the first position, a position beyond the printing area of the printer. Ink can leak from a cartridge when the cartridge is removed from the carriage. This leaking of ink can contaminate paper if the cartridge is replaced while paper is present in the printing area if the cartridge is not removed from the printing area. The carriage may also be propelled in the "B" direction so that a signal can be sent to each nozzle of a cartridge when the replacement process is completed to verify the color tone of the cartridge. However, when paper is not present in the printing area, the carriage of a printer is still moved in the "B" direction.

The method and device of the present invention allow the cartridge to be identified by integrating a memory device (not shown) with the cap of the cartridge to store all the relevant cartridge information.

Figure 3A:
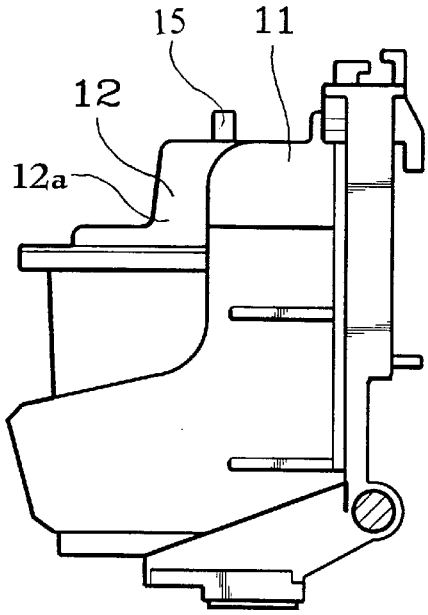
FIG. 3A is a side view illustrating a cartridge as constructed according to the principles of the present invention mounted inside a carriage.
Figure 3B:
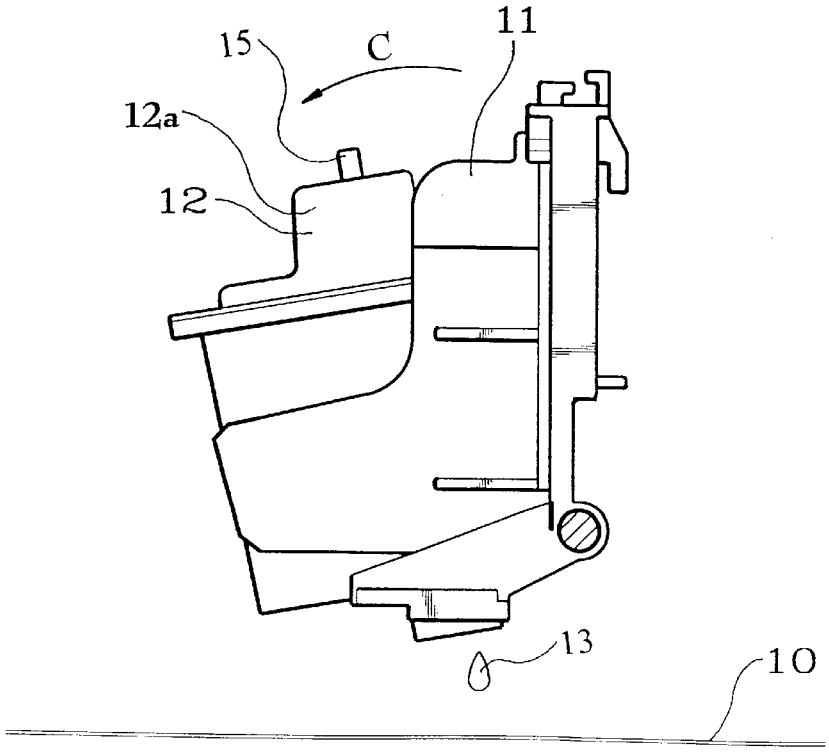
FIG. 3B is a side view illustrating the cartridge of FIG. 3A.

FIGS. 3A and 3B show cartridge 12 as constructed according to the principles of the present invention. Cap 12*a* of cartridge 12 has memory device 15 attached to allow a user to easily obtain the characteristics of the ink cartridge without having to jet ink onto sheet of paper 10. FIG. 3B illustrates how ink 13 can leak from cartridge 12 when the cartridge is moved in the "C" direction. This leaking of ink can contaminate paper if the cartridge is replaced while paper is present in the printing area if the cartridge is not removed from the printing area. In addition to the integrated memory device, ink can be prevented from contaminating the paper by regulating the motion of the carriage.

Figure 4:
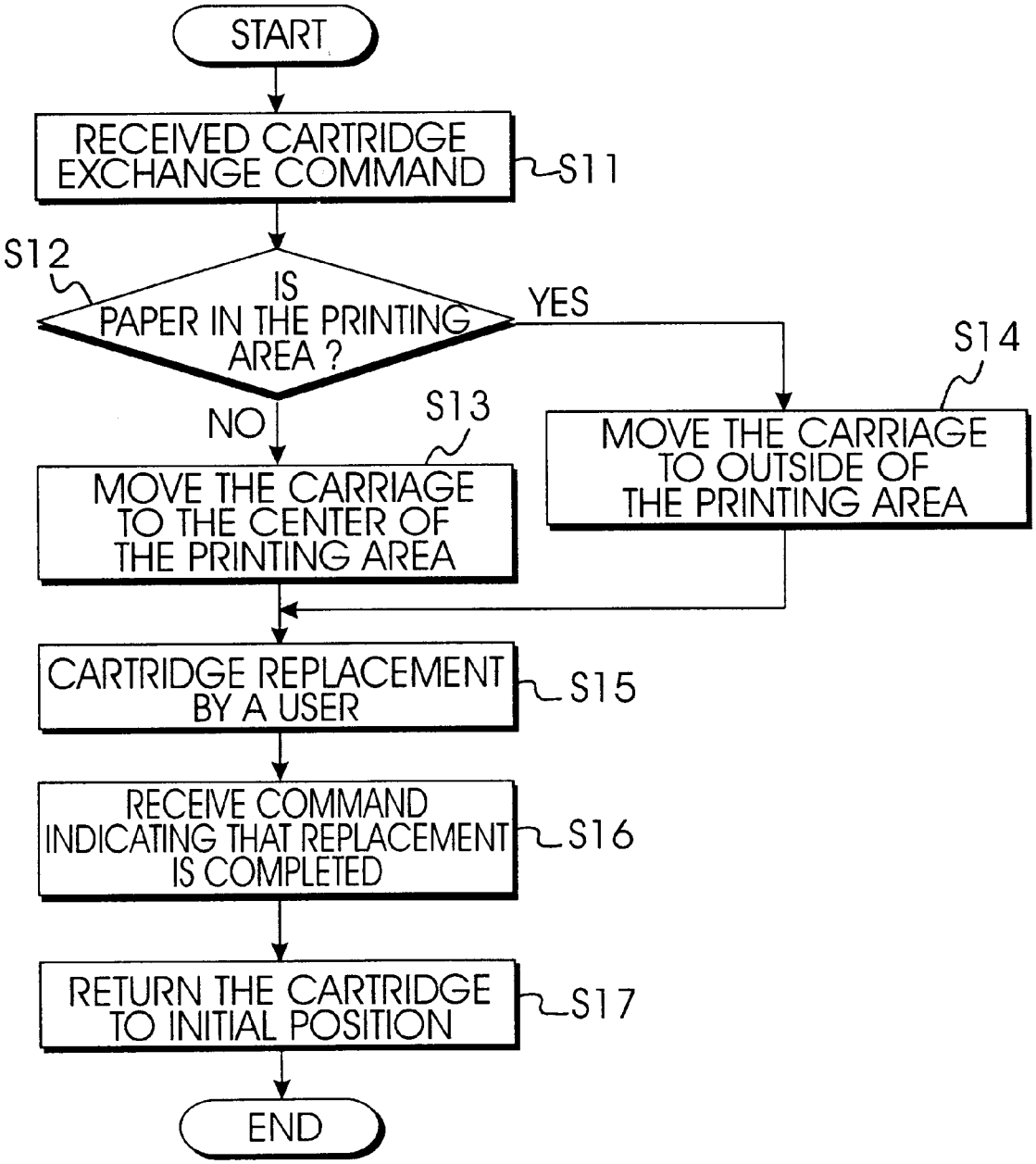
FIG. 4 is a flow chart illustrating a method of controlling the position of a carriage in accordance with the principles of the present invention.
Figure 5:
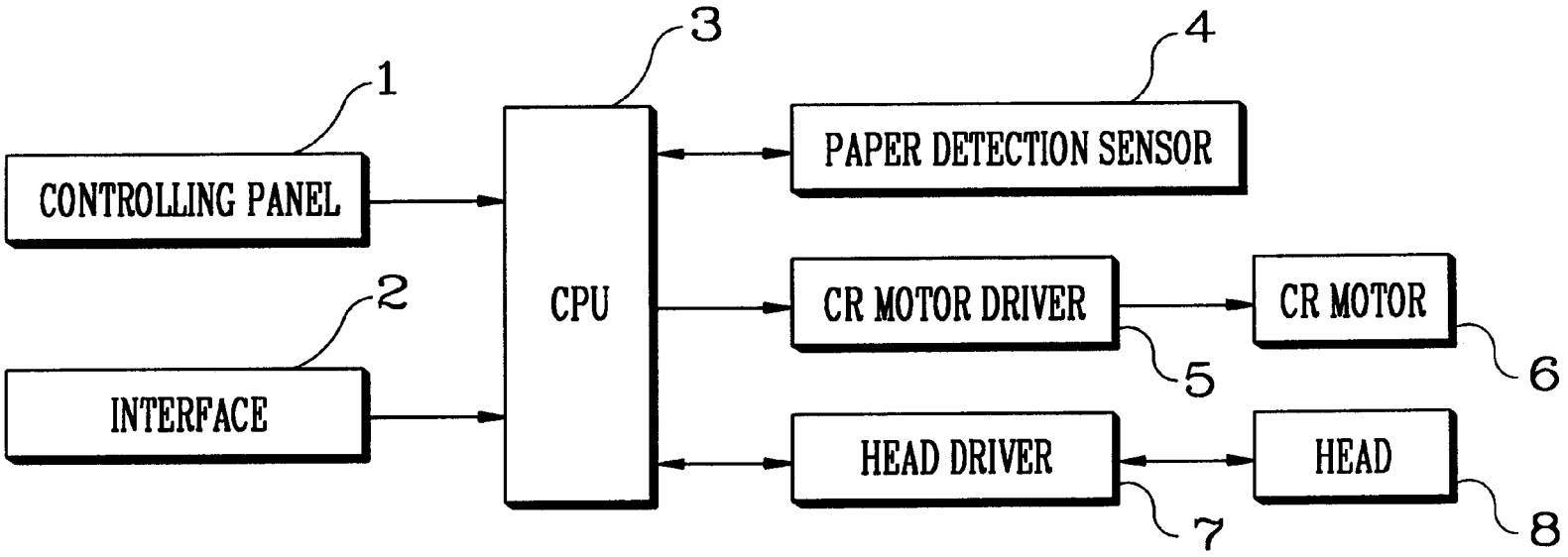
FIG. 5 is a block diagram illustrating a device as constructed according to the principles of the present invention.

FIG. 4 is a flow chart illustrating a method of controlling the movement of the carriage during the cartridge replacement process in accordance with the principles of the present invention. FIG. 5 illustrates a device that can perform the method illustrated in FIG. 4. When a user decides that cartridge 12 should be replaced, the user sends a signal to the printer representing a command to replace the cartridge to start the method. In step S11, the controller, or microprocessor, receives the command. Then, in step S12 a paper detection sensor determines whether paper is present in the printing area of the printer. The printing area is the area beneath the nozzles in the printer over which the cartridge can apply ink during one pass of the carriage over the paper. If paper is detected, then, in step S14, the controller causes the carriage to be moved, in the "B" direction as shown in FIGS. 1 and 2, outside of the printing area, to a position referred to as first position. If no paper is detected in the printing area, then in step S13, the carriage is moved to the center of the printing area, also referred to as the second position. The second position is shown by dashed lines 20 in FIG. 2. After either step S13 or step S14 is performed, the printer advances to step S15. During step S15, the printer provides the user with an opportunity to exchange a new cartridge for the old cartridge that is mounted on the carriage. After the new cartridge has been mounted inside of the carriage, the user sends a signal to the printer representing the completion of the replacement process. Then, in step S16, the printer receives the command indicating that replacement is completed. Then, during step S17, the carriage is returned to the position that the carriage originally occupied prior to the beginning of the cartridge replacement process. This new method allows a user to avoid contaminating paper during the cartridge replacement process while reducing the amount of time that is consumed when there is no paper in the printer.

The device shown in FIG. 5 is used to perform the method illustrated in FIG. 4. When a user decides that cartridge 12 should be replaced, the user sends a signal to the printer representing a command to replace the cartridge. The command can be input into the printer via operating panel 1 on the printer or via an attached computer system, or other interface, 2.

When the controller, or microprocessor or central processing unit, 3 of the printer receives the command, paper detection sensor 4 is used to check whether there is any paper in the printing area. If the paper detection sensor determines that there is no paper in the printing area, then the controller activates carriage return driver 5 to cause carriage return motor 6 to move the carriage to the center of the printing area, also referred to as the second position. After the user has replaced the cartridge a command is sent to the controller indicating the completion of the replacement process. When the controller receives the command indicating the completion of the replacement process, the carriage return motor returns the carriage to the position it was in prior to the beginning of the replacement process. At this point the cartridge is ready to print again and the controller guides the printer via head driver 7 to cause printing head 8 to expel ink.

As described above, the method and device for controlling a carriage according to the principles of the present invention reduces the amount of time consumed waiting for a carriage to be moved from the printing area, reduces the probability of polluting a sheet of paper that is within the printing area during the replacement of an ink cartridge, allows more space around the cartridge to facilitate the removal of the cartridge, and moves the carriage to a position depending on whether paper is detected in the printing area.

Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A method of controlling a carriage in an ink jet apparatus, comprising the steps of:

receiving a signal representing a command to replace a cartridge that is currently mounted in said carriage;

determining whether a sheet of paper is present in a printing area of said cartridge via a sensor attached to said ink jet apparatus; and moving said carriage to one of a plurality of stop positions depending on whether said sheet of paper was detected in said printing area.

2. The method of claim 1, further comprised of said printing area being defined as an area over which said cartridge transports while jetting an ink onto said sheet of paper.

3. The method of claim 2, further comprised of said first stop position being located outside of said printing area of said cartridge.

4. The method of claim 3, with said step of moving said carriage further comprised of moving said carriage to said first stop position when said sheet of paper is detected in said printing area.

5. The method of claim 4, further comprised of a second stop position being located in a center of said printing area.

6. The method of claim 5, with said step of moving said carriage being further comprised of moving said carriage to said first stop position when said sheet of paper is not detected in said printing area.

7. The method of claim 6, further comprising the steps of:

waiting for a new cartridge to be inserted in said carriage after said carriage has been moved to one of said plurality of stop positions; and returning said carriage to a position that said carriage occupied prior to receiving said command to exchange said cartridge.

8. A method of controlling a carriage in an ink jet apparatus, comprising the steps of:

receiving a signal representing a command to replace a cartridge that is currently mounted in said carriage;

determining whether a sheet of paper is present in a printing area of said cartridge, as defined as a rectangular area over which said cartridge can apply an ink while transporting over said sheet of paper, via a sensor attached to said ink jet apparatus;

moving said carriage to any one of a first stop position and a second stop position depending on whether said sheet of paper was detected in said printing area, said first stop position being located outside of said printing area of said cartridge and said second stop position being located in a center of said printing area.

9. The method of claim 8, with said step of moving said carriage further comprised of moving said carriage to said first stop position when said sheet of paper is detected in said printing area.

10. The method of claim 9, with said step of moving said carriage being further comprised of moving said carriage to said second stop position when said sheet of paper is not detected in said printing area.

11. The method of claim 10, further comprising the steps of:

waiting for a new cartridge to be inserted in said carriage after said carriage has been moved to one of said plurality of stop positions; and returning said carriage to a position that said carriage occupied prior to receiving said command to exchange said cartridge.

12. An ink jet apparatus, comprising:

a housing;

means for transporting a sheet of paper through said housing;

a carriage slidably mounted inside said housing;

a controller attached to said housing capable of receiving a command to replace said cartridge;

a cartridge mounted in said carriage and propelling an ink onto said sheet of paper, under the control of said controller, to form an image on said sheet of paper;

a sensor that determines whether paper is present in a printing area when said controller receives said command to replace said cartridge;

a paper detection sensor attached to said housing that determines whether said sheet of paper is in a printing area after said controller receives said command to replace said cartridge;

said cartridge, under the control of said controller, moving to a first stop position located outside of said printing area of said cartridge when said paper detection sensor detects said sheet of paper in said printing area; and said cartridge moving to a second stop position located in a center of said printing area when said paper detection sensor does not detect said sheet of paper in said printing area.

13. The ink jet apparatus of claim 12, further comprising:

a carriage return motor that moves said carriage under the direction of said controller; and a carriage return motor driver for controlling the operation of said carriage return motor.

14. The ink jet apparatus of claim 12, further comprising said controller being a microprocessor.

15. The ink jet apparatus of claim 14, further comprising a display means for interfacing with a user.

16. The ink jet apparatus of claim 15, further comprising said cartridge having a memory device attached to a cap of said cartridge to identify a color and a type of said ink contained in said cartridge.

17. An ink jet apparatus, comprising:

a housing;

means for transporting a sheet of paper through said housing;

a carriage slidably mounted inside said housing;

a controller attached to said housing capable of receiving a command to replace said cartridge;

a cartridge mounted in said carriage and propelling an ink onto said sheet of paper, under the control of said controller, to form an image on said sheet of paper, said cartridge having a memory device attached to a cap of said cartridge to identify a color and a type of said ink contained in said cartridge;

a sensor that determines whether paper is present in a printing area when said controller receives said command to replace said cartridge;

a paper detection sensor attached to said housing that determines whether said sheet of paper is in a printing area after said controller receives said command to replace said cartridge;

said cartridge, under the control of said controller, moving to a first stop position located outside of said printing area of said cartridge when said paper detection sensor detects said sheet of paper in said printing area; and said cartridge moving to a second stop position located in a center of said printing area when said paper detection sensor does not detect said sheet of paper in said printing area.

18. The ink jet apparatus of claim 12, further comprising:

a carriage return motor that moves said carriage under the direction of said controller; and a carriage return motor driver for controlling the operation of said carriage return motor.

19. The ink jet apparatus of claim 12, further comprising said controller being a microprocessor.

20. The ink jet apparatus of claim 14, further comprising a display means for interfacing with a user.

* * * * *